US011878724B2

(12) United States Patent
Zaerr et al.

(10) Patent No.: US 11,878,724 B2
(45) Date of Patent: Jan. 23, 2024

(54) AUTORACK CARS

(71) Applicant: GUNDERSON LLC, Portland, OR (US)

(72) Inventors: Jon B. Zaerr, Portland, OR (US); Brant Alec Buchanan, Vancouver, WA (US)

(73) Assignee: Gunderson LLC, Portland, OR (US)

( * ) Notice: Subject to any disclaimer, the term of this patent is extended or adjusted under 35 U.S.C. 154(b) by 250 days.

(21) Appl. No.: 17/387,162

(22) Filed: Jul. 28, 2021

(65) Prior Publication Data

US 2022/0032972 A1 Feb. 3, 2022

Related U.S. Application Data

(60) Provisional application No. 63/058,028, filed on Jul. 29, 2020.

(51) Int. Cl.

| | |
|---|---|
| ***B61D 3/04*** | (2006.01) |
| ***B61D 3/18*** | (2006.01) |
| ***B61D 3/02*** | (2006.01) |

(52) U.S. Cl.

CPC ..... *B61D 3/187* (2013.01); *B61D 3/02* (2013.01); *B61D 3/04* (2013.01)

(58) Field of Classification Search

CPC . B61D 3/187; B61D 3/02; B61D 3/04; B61D 47/005; B60P 1/02

See application file for complete search history.

(56) References Cited

U.S. PATENT DOCUMENTS

| | | | | |
|---|---|---|---|---|
| 3,066,816 | A | 12/1962 | Schwartz | |
| 3,424,489 | A | 1/1969 | Hoy | |
| 3,426,704 | A | 2/1969 | Blunden | |
| 3,866,543 | A * | 2/1975 | Richard | B61D 3/18 105/370 |
| 4,059,055 | A * | 11/1977 | Ravani | B61D 3/04 410/13 |
| 4,149,472 | A | 4/1979 | Naves et al. | |

(Continued)

FOREIGN PATENT DOCUMENTS

DE 101291146 A1 5/2002

OTHER PUBLICATIONS

Parts Catalog from Transco Railway Products, Inc. retrieved on Apr. 29, 2020 from https://www.transcorailway.com/fabrication/Downloads/TRPI%20Catalog%2002-2011-L.pdf, 2011, 161 pages.

*Primary Examiner* — Mark T Le

(74) *Attorney, Agent, or Firm* — Chernoff, Vilhauer, McClung & Stenzel, LLP

(57) ABSTRACT

Autorack cars, may include a car body and a pair of wheeled trucks supporting the car body. The autorack cars may additionally include a stationary deck segment fixedly attached to the car body and at least one pivoting deck segment that is adjacent to the stationary deck segment and that is pivotably connected to the stationary deck segment such that the at least one pivoting deck segment is pivotable between a lowered position and a raised position relative to the stationary deck segment. The at least one pivoting deck segment may be adapted to support at least one vehicle in the lowered and raised positions. The autorack cars may further include at least one pivot assembly for moving the at least one pivoting deck segment between the lowered and raised positions.

19 Claims, 11 Drawing Sheets

(56) References Cited

U.S. PATENT DOCUMENTS

| | | | | |
|---|---|---|---|---|
| 4,238,168 | A * | 12/1980 | Naves | B61D 3/18 410/27 |
| 4,318,649 | A | 3/1982 | Roldness et al. | |
| 4,759,669 | A * | 7/1988 | Robertson | B61D 3/02 410/27 |
| 6,325,579 | B1 | 12/2001 | James | |
| 6,623,223 | B1 | 9/2003 | Wrobley et al. | |
| 6,749,380 | B2 | 6/2004 | Recupido et al. | |
| 6,854,400 | B2 | 2/2005 | Sullivan | |
| 7,182,569 | B2 | 2/2007 | Wrobley et al. | |
| 10,377,392 | B2 | 8/2019 | Bis et al. | |
| 2008/0141897 | A1* | 6/2008 | Zaerr | B61D 47/005 105/404 |
| 2014/0123872 | A1* | 5/2014 | Zaerr | B61D 3/18 105/355 |

* cited by examiner

AUTORACK CARS

CROSS REFERENCE TO RELATED APPLICATIONS

This application claims the benefit of U.S. Provisional Patent Application Ser. No. 63/058,028 filed Jul. 29, 2020 and entitled "Auto Rack Cars." The complete disclosure of the above application is hereby incorporated by reference for all purposes.

BACKGROUND OF THE INVENTION

The present invention is directed to autorack railcars or autorack cars, including autorack cars having pivotable deck segments and pivot assemblies and locking mechanisms associated with those deck segments.

An autorack (also called auto carrier or car transporter) is a specialized piece of railroad rolling stock used to transport automobiles and light trucks. For example, autorack cars are used to transport new vehicles from factories to automotive distributors, and to transport passengers' vehicles in car shuttle and motorail services. Generally, vehicles are circus loaded in which vehicles are sequentially loaded by driving in on one end, and out the other end upon arrival at the destination. There is a need to load more and larger vehicles onto autorack cars. Moreover, various sizes of vehicles may need to be shipped along the route of an autorack car. Currently, autorack cars do not have the ability to be quickly changed to a different deck height. Therefore, coordinating the movement of vehicles may at times be limited to only those autorack cars that are available and suitably configured for the sizes of vehicles at hand.

What is desired, therefore, are autorack cars that provide greater flexibility to improve car utilization.

BRIEF DESCRIPTION OF THE DRAWINGS

For a better understanding of the invention, and to show how the same may be carried into effect, reference will now be made, by way of example to the accompanying drawings, which.

DETAILED DESCRIPTION OF PREFERRED EMBODIMENTS

Figure 1:
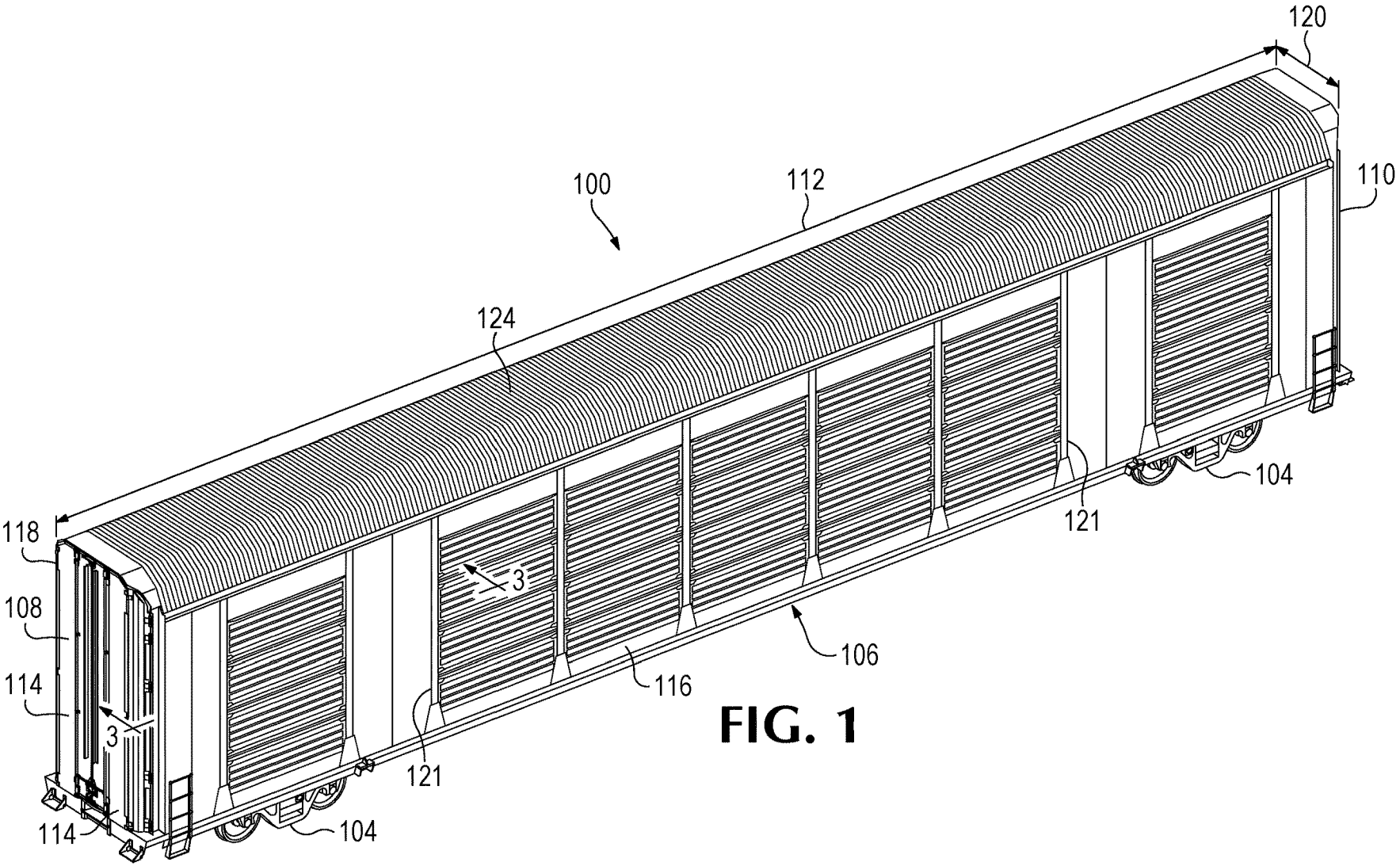
FIG. 1 is an isometric view of an illustrative example of an autorack car.
Figure 2:
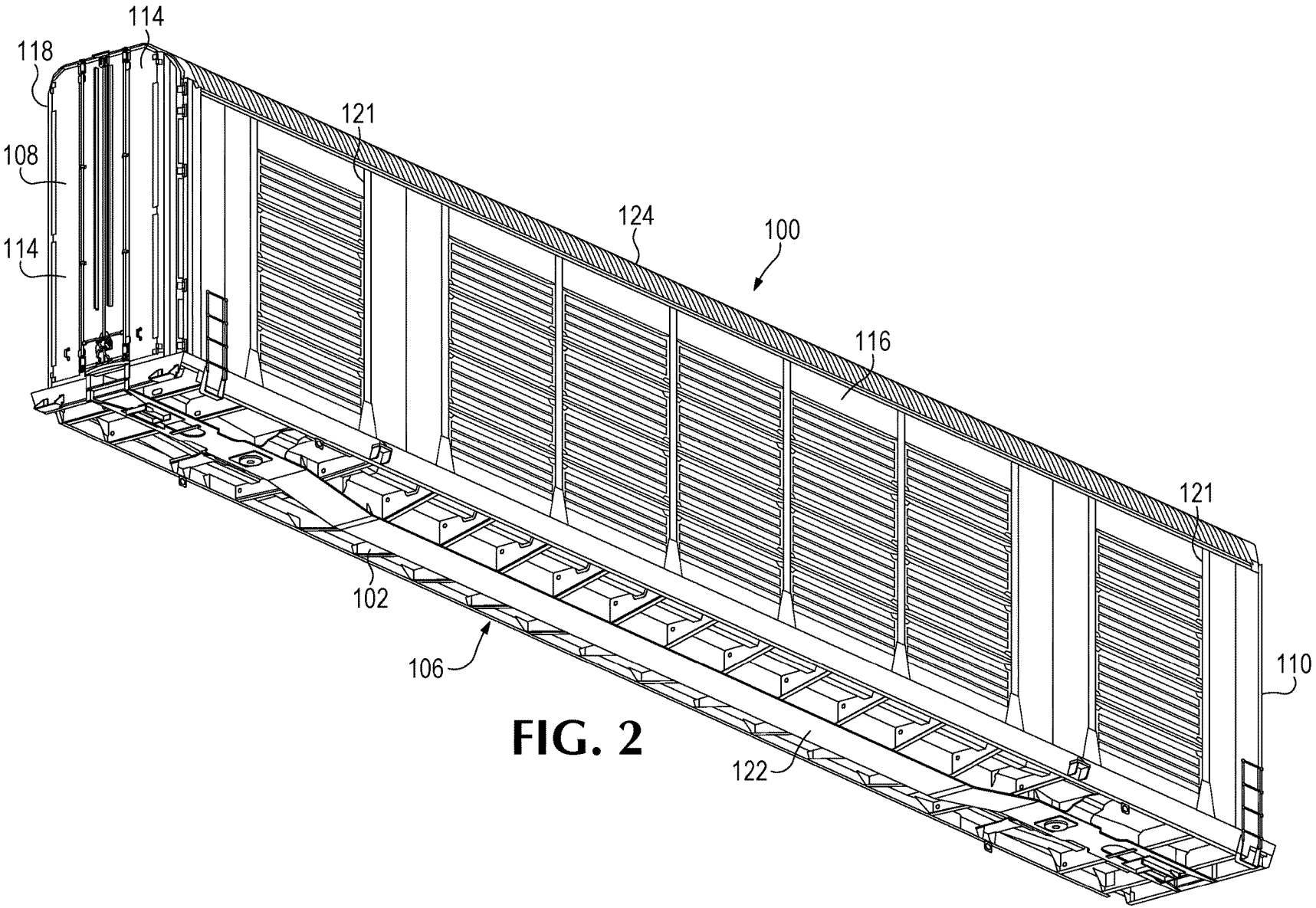
FIG. 2 is another isometric view of the autorack car of FIG. 1 shown without wheeled trucks of the autorack car.

Referring now to the drawings that form a portion of the disclosure herein, FIGS. 1-2 show an example of an autorack car 100. The autorack car includes an underframe 102 that is carried on wheeled trucks 104. A housing structure or car body 106 is supported on underframe 102 and the car body includes a pair of opposed ends 108 and 110 defining a length 112. Ends 108 and 110 are open to permit loading and unloading of automotive vehicles and include a pair of end doors 114 that move between open and closed positions. A pair of opposite sides 116 and 118 define a width 120 of the car. Car body 106 includes a plurality of posts 121 spaced along sides 116 and 118. Underframe 102 has a center sill 122 that runs substantially along length 112. A roof 124 is attached to and supported by ends 108 and 110 and sides 116 and 118.

Figure 3:
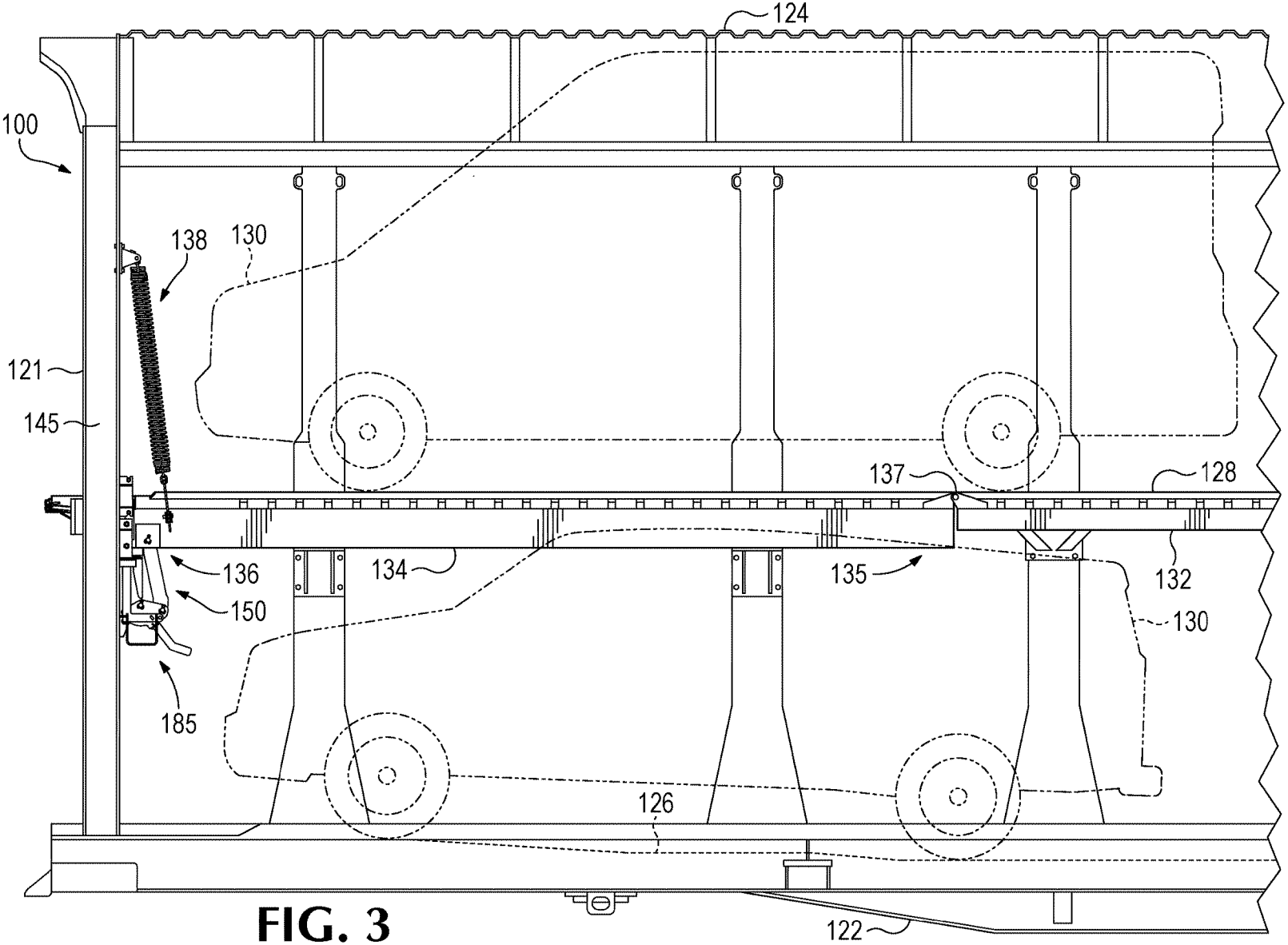
FIG. 3 is a partial sectional view of the autorack car of FIG. 1 taken along lines 3-3 in FIG. 1 with a pivoting deck segment in a lowered position.
Figure 4:
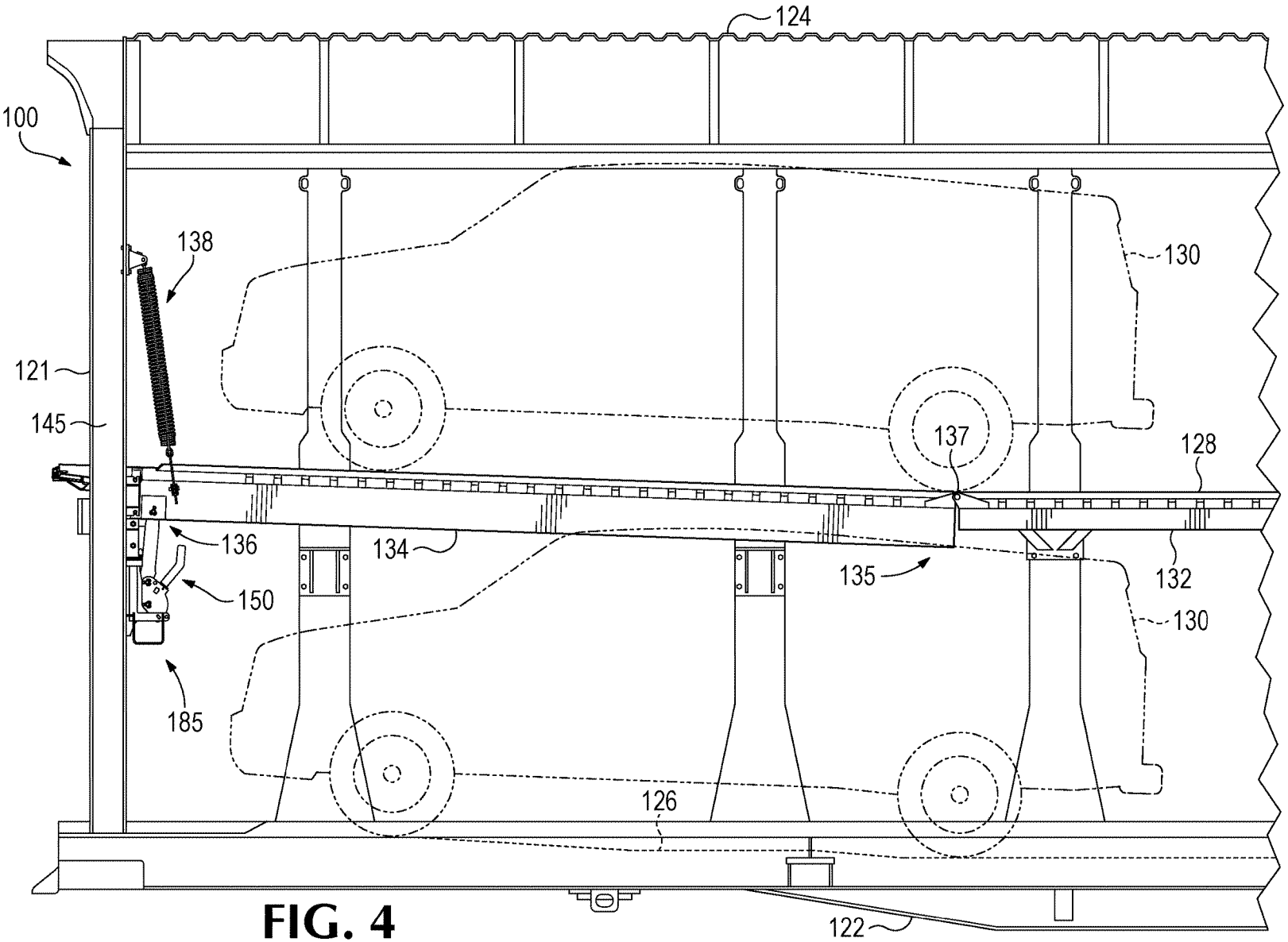
FIG. 4 is the partial sectional view of FIG. 3 with the pivoting deck segment in a raised position.

Referring to FIGS. 3-4, within car body 106 is a lower deck or A-deck 126 and an upper deck or B-deck 128 to support a plurality of vehicles 130. Upper deck 128 includes a stationary deck segment 132 and one or more pivoting deck segments 134. Pivoting deck segment 134 includes a proximal end portion 135 and a distal end portion 136. The proximal end portion of the pivoting deck segment is pivotably coupled to the stationary deck segment, such as via pivot hinges 137. Pivoting deck segment 134 is pivotable between a plurality of positions. In the example shown in FIGS. 3-4, pivoting deck segment 134 is pivotable relative to the stationary deck segment between a nominal or lowered position (such as shown in FIG. 3) and a raised or inclined position (such as shown in FIG. 4). In the lowered position, the stationary deck segment is horizontal, substantially horizontal, or less inclined than the raised position. In some embodiments, the pivoting deck segment and the stationary deck segment is co-planar when the pivoting deck segment is in the lowered position. In the raised position, the pivoting deck segment is inclined or more inclined relative to the lowered position.

As shown in FIGS. 3-4, taller vehicles may be supported on the upper deck when the pivoting deck segment is in the lowered position as compared to when the pivoting deck segment is in the raised position. In the example shown in FIGS. 3-4, stationary deck segment 132 of the upper deck is disposed between two pivoting deck segments 134 that are adjacent to ends 108 and 110. However, other embodiments may include only a single pivoting deck segment adjacent to end 108 or end 110, and/or may include pivoting deck segment(s) that are not adjacent to ends 108 and/or 110. When the pivoting deck segments are adjacent ends 108 and 110, those deck segments may also be referred to as "end deck segments" or "pivoting end deck segments."

Figure 5:
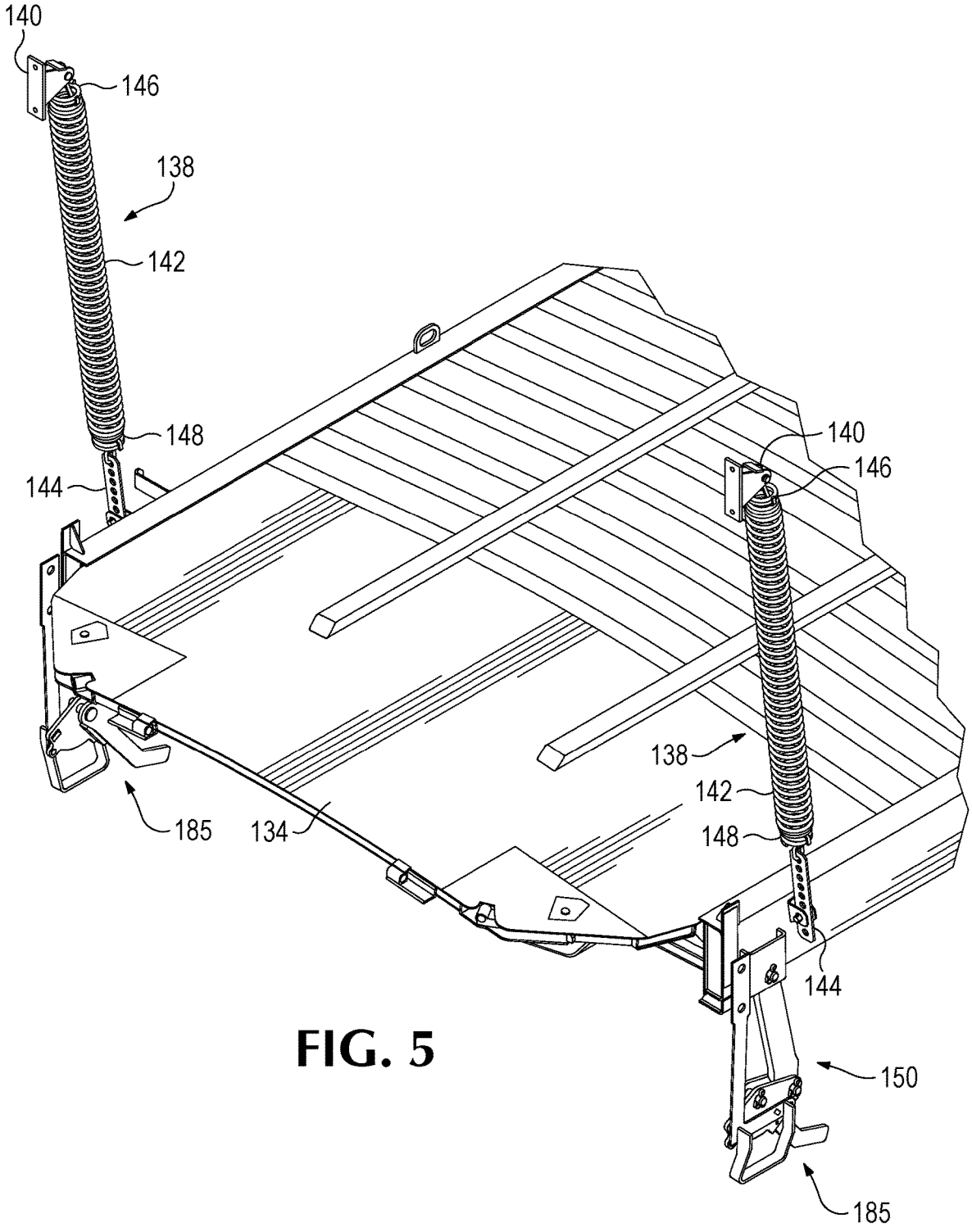
FIG. 5 is a partial isometric view of the pivoting deck segment of FIGS. 3-4.

Referring to FIG. 5, pivoting deck segment 134 is supported by a pair of spring assemblies 138, which includes a first connector 140, a spring 142, and a second connector 144. First connector 140 is fixedly attached to a post 121, such as an end post 145 shown in FIGS. 3-4, of car body 106. Second connector 144 is fixedly attached to pivoting deck segment 134. Spring 142 includes a first end 146 attached to first connector 140, and a second end 148 attached to second connector 144. A pair of pivot assemblies 150 allow a user to pivot the pivoting deck segment among the plurality of positions, such as between the lowered and raised positions. Although a pair of pivot assemblies 150 is shown in FIG. 5, other embodiments may include only a single pivot assembly or three or more pivot assemblies.

Figure 6:
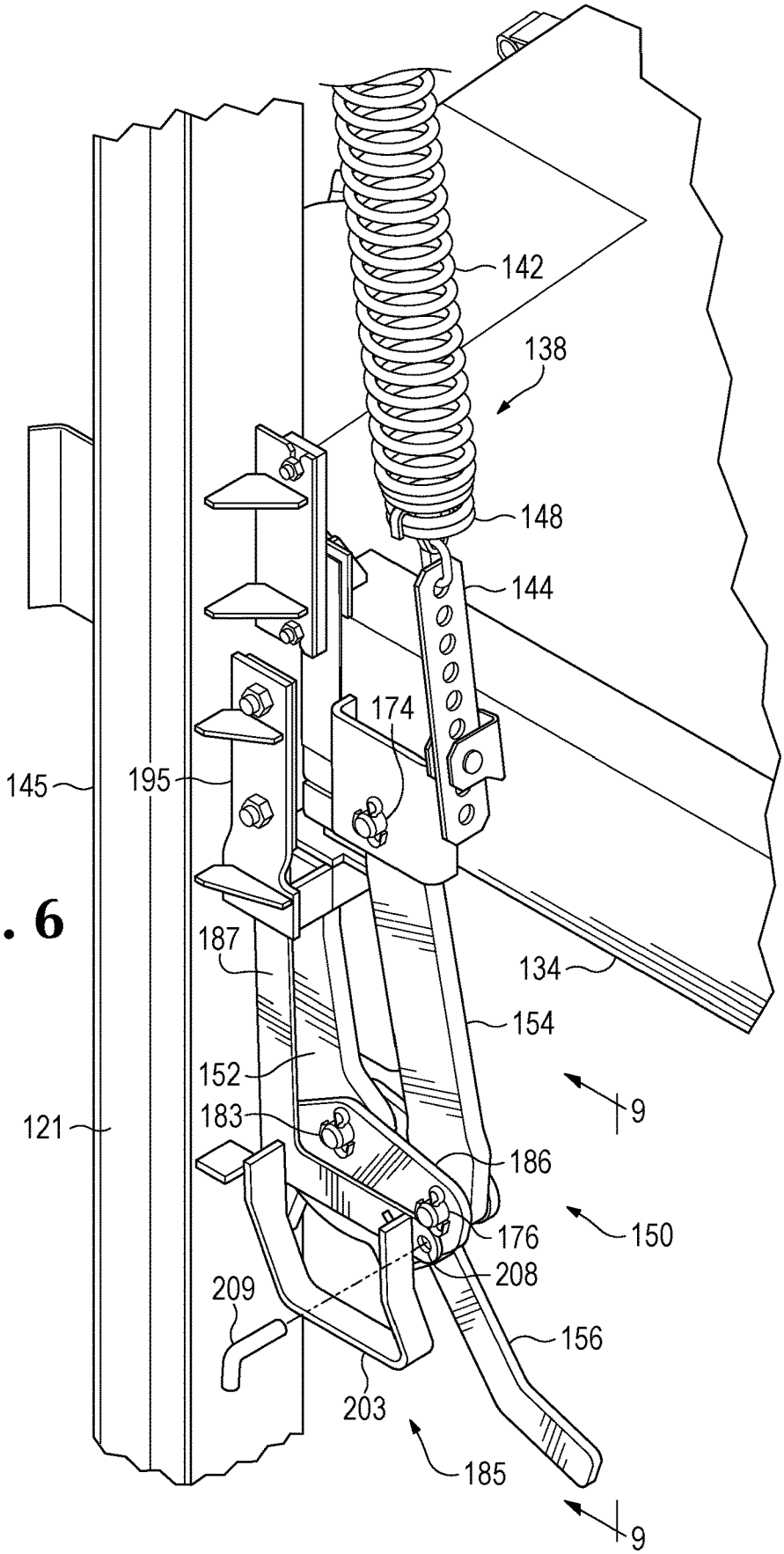
FIG. 6 is a partial isometric view of an illustrative example of a pivot assembly for the pivoting deck segment of FIGS. 3-4.
Figure 7:
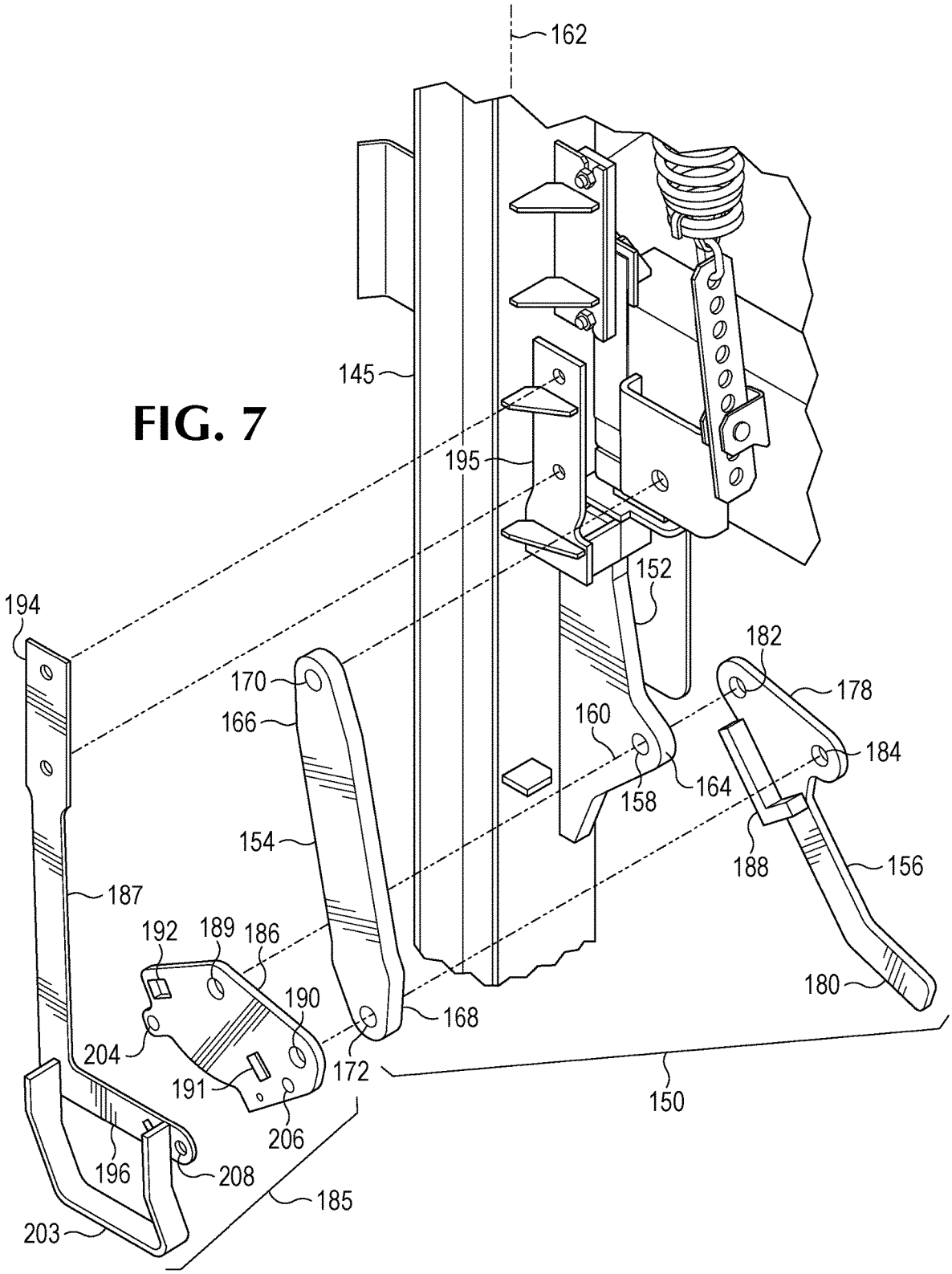
FIGS. 7-8 are exploded views of the pivot assembly of FIG. 6, shown without coupler and fasteners.
Figure 8:
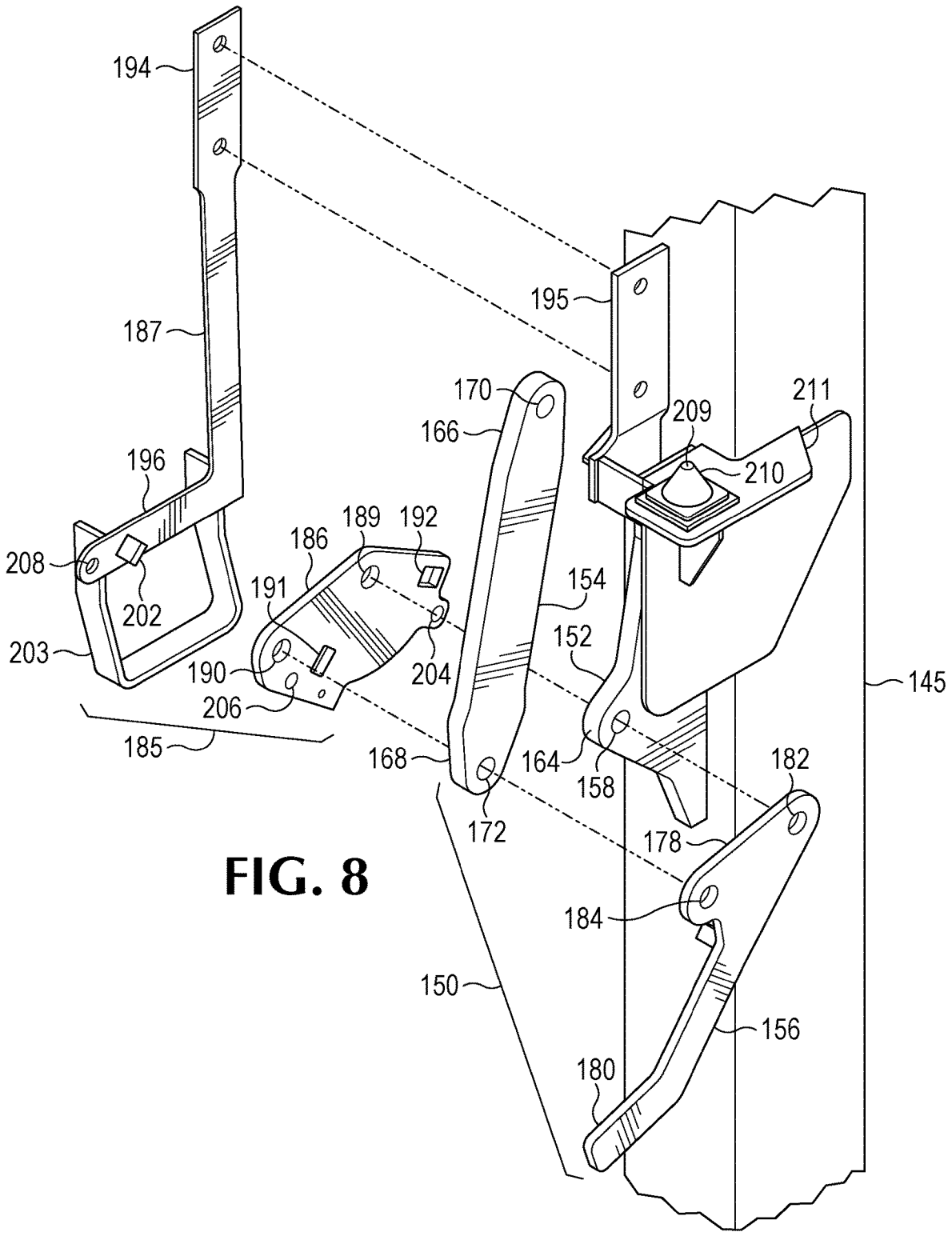

Referring to FIGS. 6-8, pivoting assembly 150 includes a base 152, a pivot arm 154, and a pivot handle 156. Base 152 is fixedly attached to post 121 of car body 106, such as end post 145. The base includes a hole 158 having an axis 160 that is perpendicular to a longitudinal axis 162 defined by end post 145. Base 152 is elongate and flat having a protruding portion 164 that extends perpendicularly outward of end post 145 and that includes hole 158. Other embodiments of base 152 may be non-elongate, non-flat, and/or may exclude the protruding portion. Pivot arm 154 is elongate and flat and includes opposed end portions 166 and 168 having holes 170 and 172 to receive couplers 174 and 176, respectively. End portion 166 is pivotably connected to pivoting deck segment 134 via coupler 174, while end portion 168 is pivotably connected to pivot handle 156 via coupler 176. Pivot arm 154 is sized such that its longitudinal axis is substantially vertical or vertical when the pivoting deck segment is in the raised position, as further discussed below.

Pivot handle 156 includes opposed end portions 178 and 180. End portion 178 is larger or wider than end portion 180. Additionally, end portion 178 includes spaced holes 182 and 184 to receive couplers 183 and 176, respectively. Moreover, spaced holes 182 and 184 are positioned such that coupler 176 is substantially or fully vertically aligned with coupler 183 when pivot handle 156 is raised. In other words, holes 182 and 184 are along a single axis that is substantially vertical or vertical when the pivoting deck segment is in the raised position, which allows end post 145 (via pivot arm 145, pivot handle 156, and base 152) to substantially or fully support pivoting deck segment 134 when in the raised position, as further discussed below. Additionally, end portion 178 is pivotably connected to base 152 and end portion 168 of pivot arm 154 via couplers 183 and 176, respectively. End portion 180 is sized to be grasped by a user's hand. In the example shown in FIGS. 6-8, end portion 180 is bent and/or forms an obtuse angle with an adjacent portion of the pivot handle. Pivot handle 156 includes a length suitable to allow, for example, a user to grasp end portion 180 of the pivot handle and move that end portion upward (further discussed below) while standing on lower deck 126.

Autorack car 100 further includes one or more locking assemblies or locking mechanisms 185 that secures or locks the pivoting deck segment in the lowered and/or raised positions. In the example shown in FIGS. 6-8, a locking mechanism 185 is associated with and/or operably connected to each of pivoting assemblies 150. However, other embodiments of autorack car 100 may include one or more pivoting assemblies 150 without a locking mechanism 185 associated with those assemblies. Locking mechanism 185 includes a locking plate 186 and a locking arm 187. Locking plate 186 is fixedly attached to end portion 178 via a spacer 188 that is fixedly attached to both the locking plate and end portion 178. In other words, spacer 188 is disposed between locking plate 186 and end portion 178 of pivot handle 156. Spacer 188 is L-shaped but other embodiments of spacer 188 may include one or more other shapes. In the example shown in FIGS. 6-8, base 152 also is disposed between locking plate 186 and end portion 178 of pivot handle 156. Because locking plate 186 is fixedly attached to pivot handle 156, the locking plate pivots or moves when pivot handle 156 is pivoted or moved. Locking plate 186 includes spaced pivot apertures 189 and 190, and spaced locking apertures 191 and 192. Pivot apertures 189 and 190 receive couplers 183 and 176, respectively, to allow the locking plate to move with the pivot handle. Locking apertures 191 and 192 are each sized to receive a pin of locking arm 187 (further discussed below). Locking aperture 191 is positioned to receive the pin when the pivoting deck segment is in the lowered position to secure or lock the pivoting deck segment in the lowered position. Locking aperture 192 is positioned to receive the pin when the pivoting deck segment is in the raised position to secure or lock the pivoting deck segment in the raised position.

Locking arm 187 includes end portions 194 and 196. End portion 194 is fixedly attached to end post 145 of car body 106, such as via one or more brackets 195. End portion 196 is a free end portion and is not fixedly attached, which allows end portion 196 to move between a proximal or locking position shown in FIG. 9 and a distal or unlocking position shown in FIG. 10. Locking arm 187 is cantilevered and/or biased such that end portion 196 is urged toward the locking position when moved to the unlocking position. In other embodiments, locking mechanism 185 may include one or more springs (not shown) that urge the locking arm toward the locking position when that arm is moved to the unlocking position. The locking arm also includes a projection or pin 202 attached or fixedly attached to end portion 196 such that the pin extends toward the locking plate and is received in aperture 191 or 192 when the locking arm is in the locking position and the pivoting deck segment is in the lowered position or the raised position. Additionally, locking arm 187 includes a locking handle 203 attached or fixedly attached to end portion 192 to allow a user to grasp that handle and move end portion 196 between the locking and unlocking positions. Locking arm 187 is L-shaped but other embodiments may include one or more other shapes.

Figure 14:
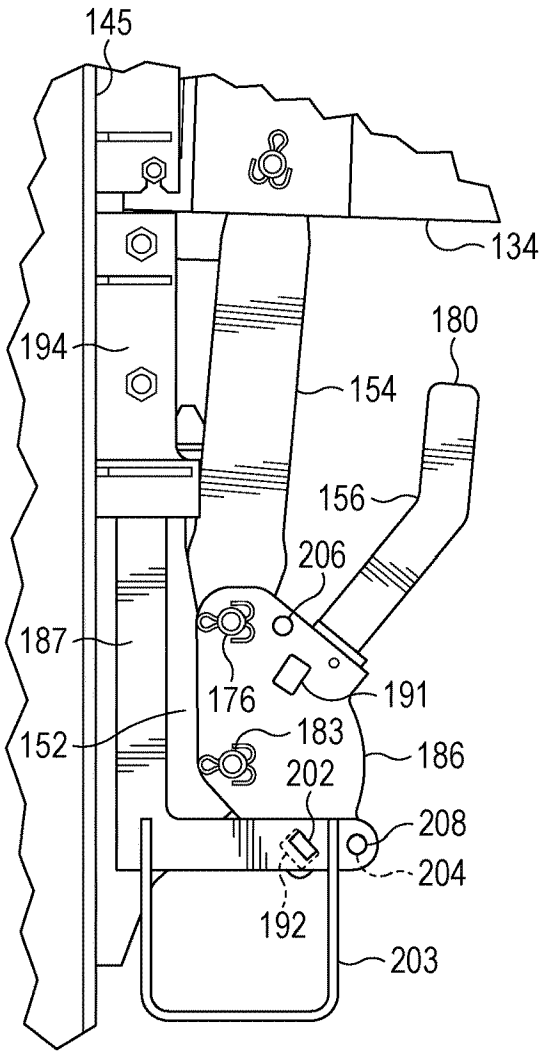
FIGS. 12-14 are partial views of the pivot assembly of FIG. 6 shown with the pivoting deck segment moved between the lowered and raised positions.
Figure 12:
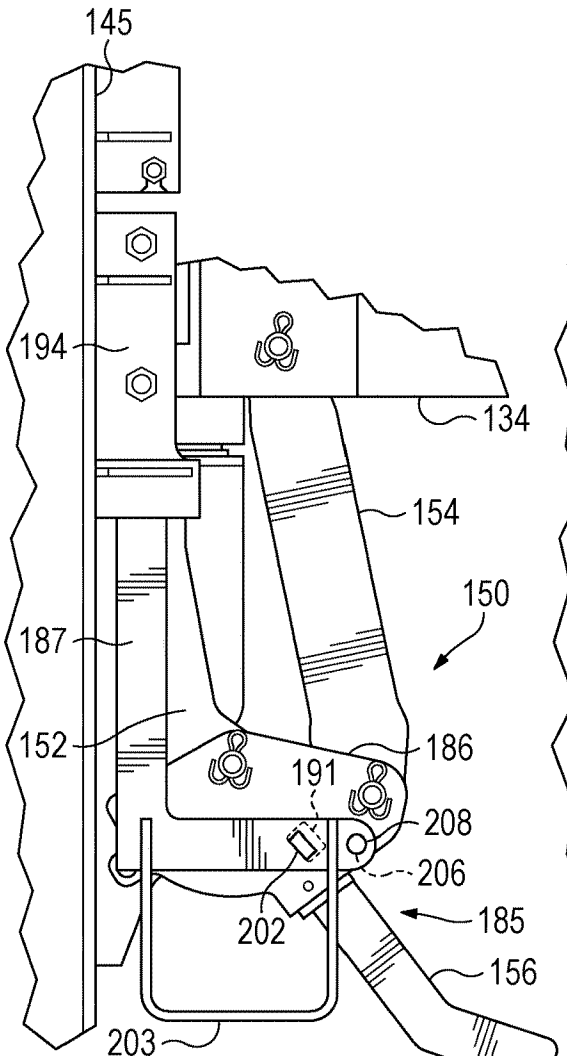

In the example shown in FIGS. 6-8, locking plate 186 includes securing apertures 204 and 206 and locking arm 187 includes at least one hole 208 that is positioned adjacent pin 202. Securing aperture 204 is positioned on locking plate 186 such that securing aperture 204 and hole 208 are aligned or co-axial when the pivoting deck segment is in the raised position (as shown in FIG. 14), which allows both securing aperture 204 and hole 208 to receive a locking rod 209 and/or other locking device (e.g., padlock, bolt and lock nut, bent piece of heavy wire, etc.). Securing aperture 206 is positioned on locking plate 186 such that aperture 206 and hole 208 are aligned or co-axial when the pivoting deck segment is in the lowered position (as shown in FIG. 12), which allows both aperture 206 and hole 208 to a locking rod 209 and/or other locking device. The above provides an additional and optional locking point to prevent, for example, inadvertent movement of the pivoting deck segment.

Figure 9:
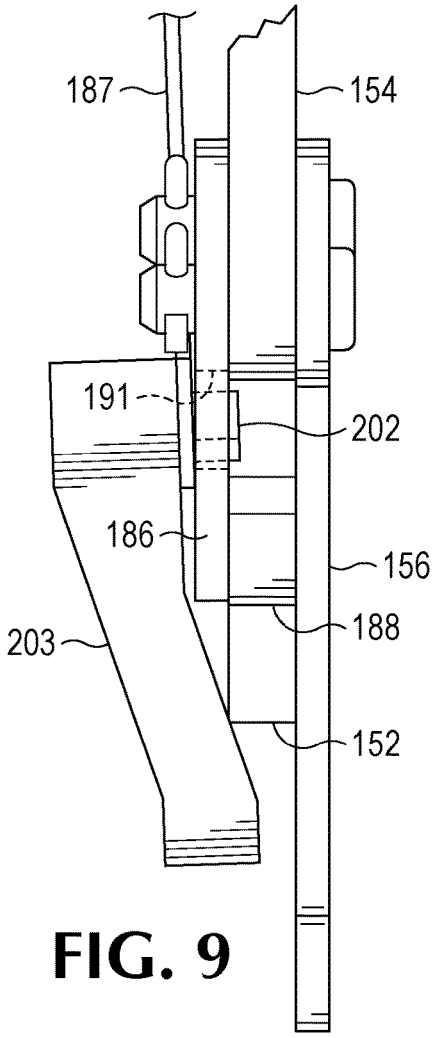
FIGS. 9-10 are partial end views of the pivot assembly of FIG. 6 shown with an illustrative example of a locking arm moved between a locking position and an unlocking position.
Figure 11:
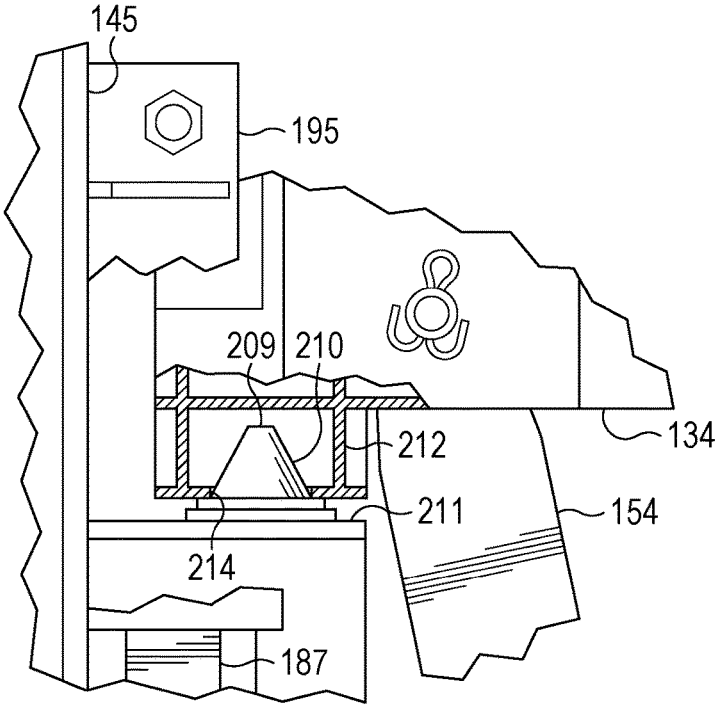
FIG. 11 is a partial view of the pivot assembly of FIG. 6 showing a portion of the pivoting deck segment in section to show support of the pivoting deck segment when in the lowered position.

Referring to FIG. 11, end post 145 includes a support member 209, such as a cone element 210, fixedly attached to end post 145, such as via a supporting bracket 211. Distal end portion 136 of pivoting deck segment 134 includes an extending portion 212 having a receiving aperture 214 that is sized to receive at least a substantial portion or all of support member 209 when the pivoting deck segment is in the lowered position (as shown in FIG. 9). The above combination of cone element 210 and receiving aperture 214 centers the pivoting deck segment when moved to the lowered position and/or prevents shifting laterally and/or longitudinally of the pivoting deck segment when in the lowered position. Additionally, the weight of pivoting deck segment 134 (and any vehicles supported by that segment) are substantially or fully supported by end post 145 when the pivoting deck segment is in the lowered position.

Because the weight of pivoting deck segment 134 and any vehicles supported by that segment is substantially or fully supported by end post 145 in the raised and lowered positions, locking mechanism 185 merely locks pivot handle 156 in the two positions corresponding to the raised and lowered positions of the pivoting deck segment and does not bear the weight of the pivoting deck segment. In other words, there is no live load applied to the locking mechanism because the pivot handle is raised to a point where the pivots are oriented one above the other when the pivoting deck segment is in the raised position, and the pivoting deck segment rests on hard stops mounted to one or more posts of the car body in the lowered position, which allows the pivoting deck segment(s) to support one or more vehicles regardless of whether the pivoting deck segment(s) are in the lowered or raised positions. Additionally, the locking mechanism restrains the pivoting deck segment from floating up due to the spring force, and stabilizes the pivoting deck segment against bouncing during empty transit.

Figure 10:
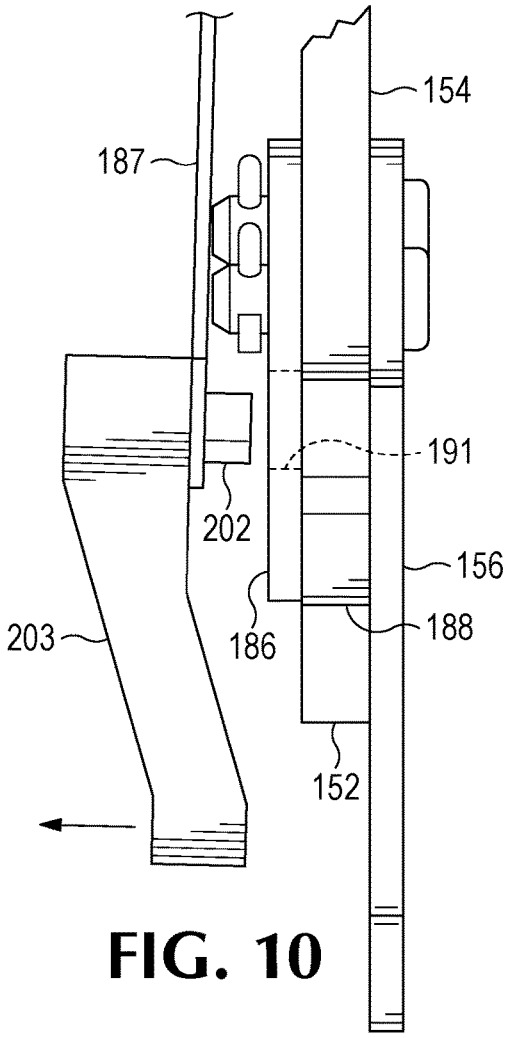
Figure 13:
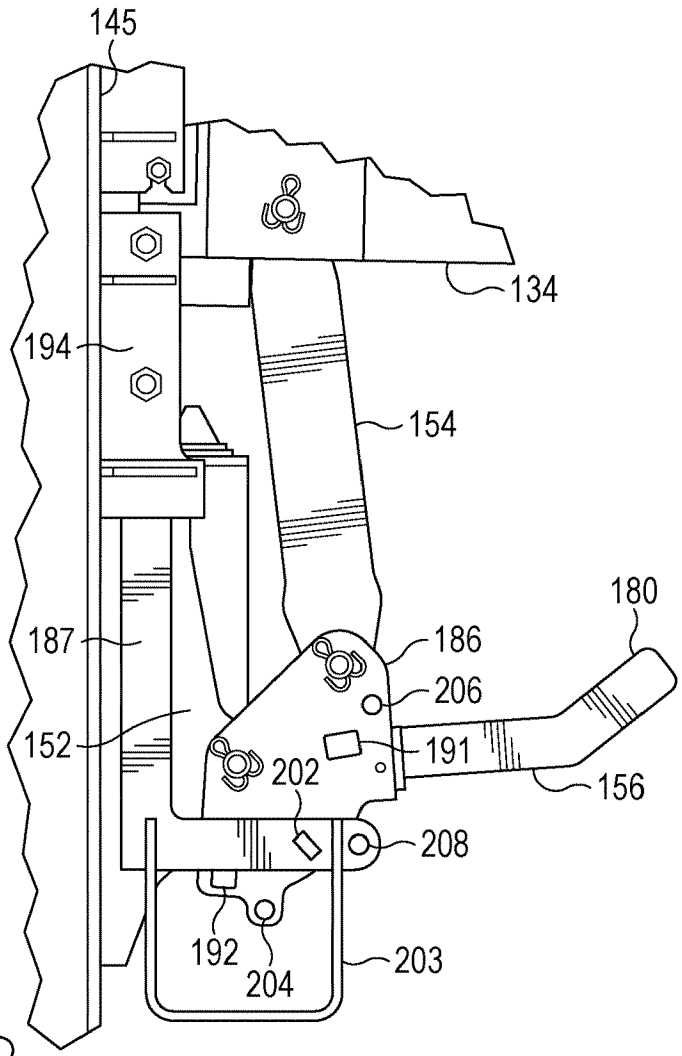

Referring to FIGS. 12-14, operation of pivoting assembly 150 and locking mechanism 185 is illustrated. In FIG. 12, pivoting deck segment 134 is in the lowered position, locking arm 187 is in the locking position, and pin 202 is received in aperture 191. In other words, locking mechanism 185 is in a configuration in FIG. 12 that mechanically locks or secures the pivoting deck segment in the lowered position. In some examples, a locking rod or other locking device may be inserted through aperture 206 and hole 208 to further secure or further mechanically lock the pivoting deck segment in the lowered position. To move the pivoting deck segment, the locking rod or other locking device, if used, is removed from the aperture 206 and hole 208. Then, a user holds locking handle 203 and moves the locking arm 187 from the locking position to the unlocking position (such as shown in FIG. 10). While the locking arm is held in the unlocking position, the user holds end portion 180 of pivot handle 156 and moves that end portion upward, as shown in FIG. 13.

Once pin 202 is spaced from aperture 191 (or no longer can be received by aperture 191 when the locking arm is in the locking position), the user can release locking handle 203 and the locking arm moves back to the locking position. As the user is moving the pivot handle, pivot arm 154 and spring 142 of the pivoting deck segment move that segment to the raised position, as shown in FIG. 14. In the raised position, a longitudinal axis defined by locking arm 154 is substantially vertical or vertical, and apertures 182 and 184 are along an axis that is substantially vertical or vertical. As shown, coupler 176 is vertically above coupler 183. In the raised position, pin 202 is received in aperture 192 to secure or mechanically lock the pivoting deck segment in that position. A locking rod and/or other locking device may be inserted through aperture 204 and hole 208 to further secure or further mechanically lock the pivoting deck segment in the raised position. In some examples, a user may move pivot handle on one side (or both sides) of the pivoting deck segment to the position shown in FIG. 13 before moving one or both pivot handles to the raised position shown in FIG. 14. A user may reverse the process described above to move the pivoting deck segment from the raise position to the lowered position.

Figure 17:
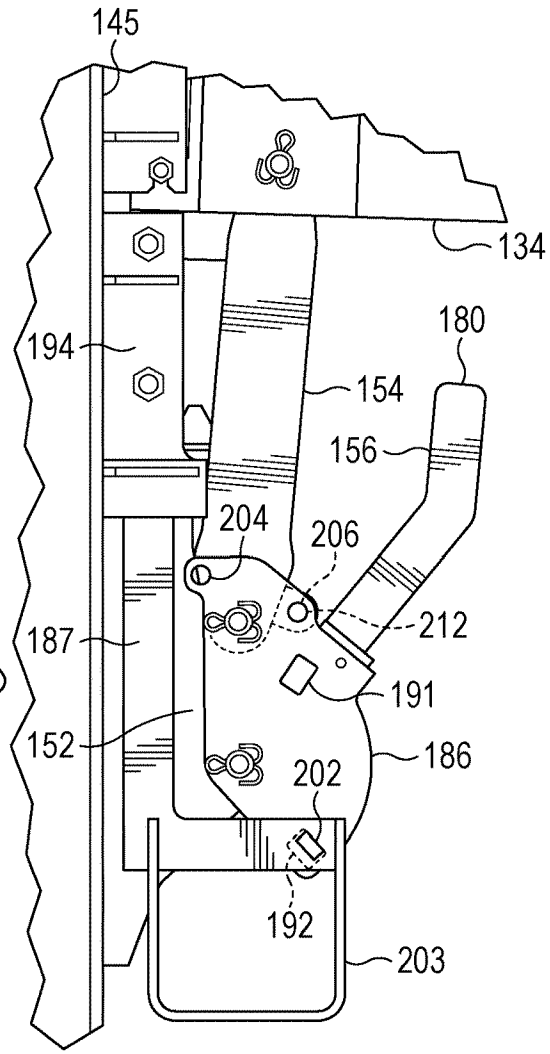
FIGS. 15-17 are partial views of another illustrative example of a pivot assembly shown with the pivoting deck segment moved between the lowered and raised positions.
Figure 16:
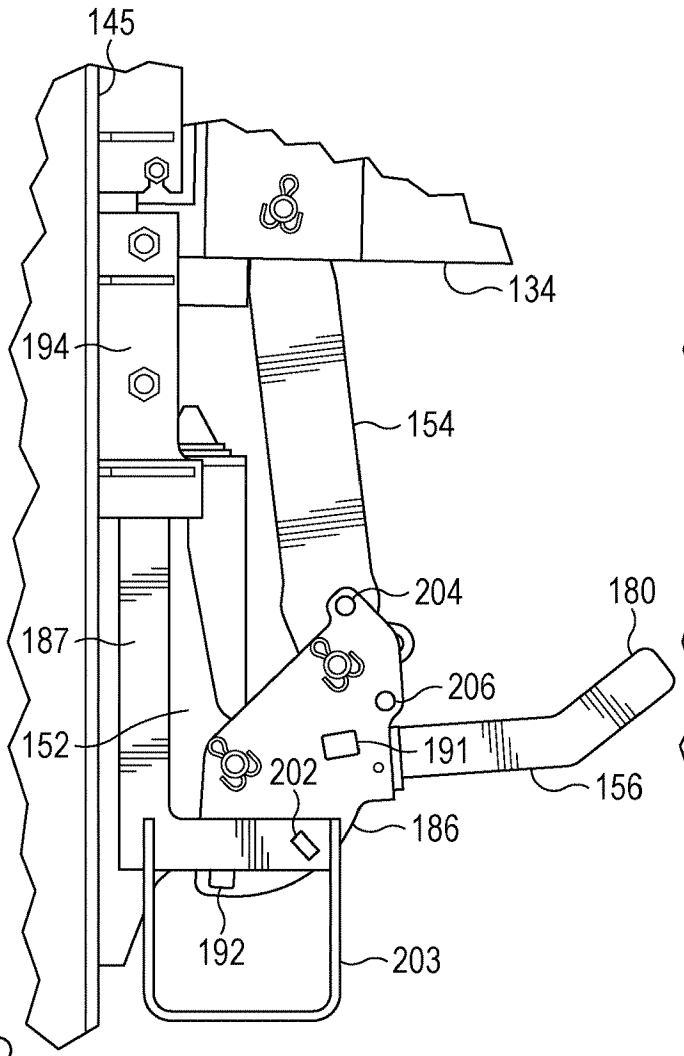
Figure 15:
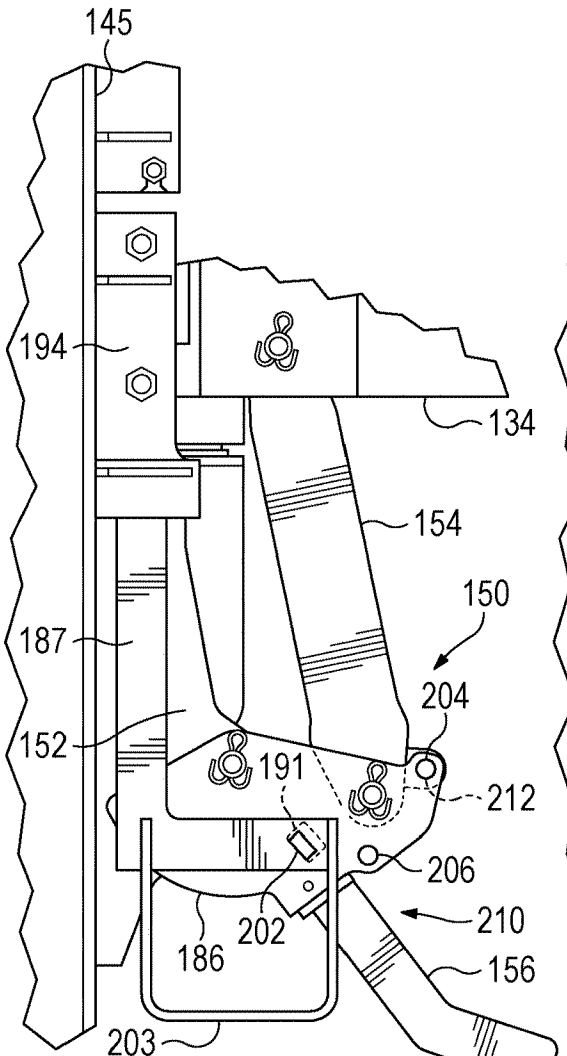

Referring to FIGS. 15-17, an alternative embodiment of locking mechanism 185 is shown, which is generally indicated at 210. Unlike locking mechanism 185, locking arm 187 does not include a hole 208. Instead, pivot arm 154 includes a hole 212. The third aperture is positioned on locking plate 186 such that aperture 206 and hole 212 are aligned or co-axial when the pivoting deck segment is in the lowered position (as shown in FIG. 15), which allows both aperture 206 and hole 212 to receive a locking rod and/or other locking device to further secure or further mechanically lock the pivoting deck segment in the lowered position. Aperture 204 is positioned on locking plate 186 such that aperture 204 and hole 212 are aligned or co-axial when the pivoting deck segment is in the raised position (as shown in FIG. 17), which allows both fourth aperture 204 and hole 212 to receive a locking rod and/or other locking device to further secure or further mechanically lock the pivoting deck segment in the raised position.

One of the many advantages provided by the present disclosure is that the above autorack cars allow the loading of standard vehicles or taller vehicles on the B-deck. Additionally, the pivot bar assemblies provide the user with the ability to move segments of the B-deck up or down using a handle that is reachable by the user without having to directly contact and move the B-deck, which is generally about 89 inches above the A-deck. Moreover, the present disclosure provides a strong hinging upper deck that can be raised or lowered quickly and manually and that can support one or more vehicles on the hinging upper deck regardless of the position of that deck. The ability to redispose the upper deck helps to accommodate different sizes of vehicles with a minimum of effort and time.

It will be appreciated that the invention is not restricted to the particular embodiment that has been described, and that variations may be made therein without departing from the scope of the invention as defined in the appending claims, as interpreted in accordance with principles of prevailing law, including the doctrine of equivalents or any other principle that enlarges the enforceable scope of a claim beyond its literal scope. Unless the context indicates otherwise, a reference in a claim to the number of instances of an element, be it a reference to one instance or more than one instance, requires at least the stated number of instances of the element but is not intended to exclude from the scope of the claim a structure or method having more instances of that element than stated. The word "comprise" or a derivative thereof, when used in a claim, is used in a nonexclusive sense that is not intended to exclude the presence of other elements or steps in a claimed structure or method.

What is claimed is:

1. An autorack railcar, comprising:

(a) a car body having a pair of opposed sides and a pair of opposed ends;

(b) a pair of wheeled trucks supporting the car body, each of the trucks being located adjacent a respective one of the pair of opposed ends;

(c) a stationary deck segment fixedly attached to the car body;

(d) at least one pivoting deck segment that is adjacent to the stationary deck segment and that is pivotably connected to the stationary deck segment such that the at least one pivoting deck segment is pivotable between a lowered position and a raised position relative to the stationary deck segment, wherein the at least one pivoting deck segment is adapted to support at least one vehicle in the lowered and raised positions; and (e) at least one pivot assembly for moving the at least one pivoting deck segment between the lowered and raised positions, wherein the at least one pivot assembly includes:

(i) a base fixedly attached to the car body, (ii) a pivot arm having opposed first and second end portions, the first end portion being pivotably connected to the at least one pivoting deck segment, and (iii) a handle having opposed third and fourth end portions, the third end portion being pivotably connected to the base and to the second end portion of the pivot arm, and the fourth end portion being sized to be grasped by a hand, wherein the pivot arm is sized such that a longitudinal axis of the pivot arm is substantially vertical when the at least one pivoting deck segment is in the raised position, and wherein the third end portion includes a first aperture that receives a first coupler to pivotably connect the third end portion to the base, and a second aperture that receives a second coupler to pivotably connect the third end portion to the second end portion of the pivot arm, the first and second apertures being positioned on the third end portion such that the first and second apertures are along a substantially vertical axis when the at least one pivoting deck segment is in the raised position.

2. The railcar of claim 1, further comprising a support member fixedly attached to the car body, wherein the at least one pivoting deck segment includes a proximal end portion and a distal end portion, the proximal end portion being pivotably connected to the stationary deck segment and the distal end portion being in contact with and supported by the support member when the at least one pivoting deck segment is in the lowered position.

3. The railcar of claim 1, further comprising a locking mechanism that secures the at least one pivoting deck segment in the raised position.

4. The railcar of claim 3, wherein the locking mechanism secures the at least one pivoting deck segment in the lowered position.

5. An autorack railcar, comprising:

(a) a car body having a pair of opposed sides and a pair of opposed ends;

(b) a pair of wheeled trucks supporting the car body, each of the trucks being located adjacent a respective one of the pair of opposed ends;

(c) a stationary deck segment fixedly attached to the car body;

(d) at least one pivoting deck segment that is adjacent to the stationary deck segment and that is pivotably connected to the stationary deck segment such that the at least one pivoting deck segment is pivotable between a lowered position and a raised position relative to the stationary deck segment, wherein the at least one pivoting deck segment is adapted to support at least one vehicle in the lowered and raised positions;

(e) at least one pivot assembly for moving the at least one pivoting deck segment between the lowered and raised positions, wherein the at least one pivot assembly includes:

(i) a base fixedly attached to the car body, (ii) a pivot arm having opposed first and second end portions, the first end portion being pivotably connected to the at least one pivoting deck segment, and (iii) a handle having opposed third and fourth end portions, the third end portion being pivotably connected to the base and to the second end portion of the pivot arm, and the fourth end portion being sized to be grasped by a hand; and (f) a locking mechanism that includes:

(1) a locking plate fixedly attached to the third end portion of the handle, the locking plate including a first aperture, and (2) a locking arm having fifth and sixth end portions, the fifth end portion being fixedly attached to the car body, and the sixth end portion having a pin sized to be received in the first aperture, wherein the first aperture receives the pin when the at least one pivoting deck segment is in the raised position such that the at least one pivoting deck segment is secured in the raised position.

6. The railcar of claim 5, wherein the locking plate further includes a second aperture spaced from the first aperture, wherein the pin is sized to be received in the second aperture, and wherein the second aperture receives the pin when the at least one pivoting deck segment is in the lowered position such that the at least one pivoting deck segment is secured in the lowered position.

7. The railcar of claim 6, wherein the sixth end portion of the locking arm is movable between a locking position in which the pin is received in the first or second aperture when the at least one pivoting deck segment is in the raised or lowered position, respectively, and an unlocking position in which the pin is spaced from the first or second aperture relative to the locking position when the at least one pivoting deck segment is in the raised or lowered position, respectively.

8. The railcar of claim 7, wherein the sixth end portion is urged toward the locking position when moved to the unlocking position.

9. The railcar of claim 8, wherein the locking arm is cantilevered such that the sixth end portion is urged toward the locking position when the sixth end portion is moved to the unlocking position.

10. The railcar of claim 6, wherein the sixth end portion of the locking arm includes a hole spaced from the pin, and wherein the locking plate further includes a third aperture positioned such that the third aperture and the hole are co-axial when the at least one pivoting deck segment is in the raised position.

11. The railcar of claim 10, wherein the locking plate further includes a fourth aperture positioned such that the fourth aperture and the hole are co-axial when the at least one pivoting deck segment is in the lowered positioned.

12. The railcar of claim 11, wherein the locking mechanism further includes a locking rod sized to be inserted through the third aperture and the hole when the at least one pivoting deck segment is in the raised position and through the fourth aperture and the hole when the at least one pivoting deck segment is in the lowered position.

13. The railcar of claim 6, wherein the second end portion of pivot arm includes a hole, and wherein the locking plate further includes a third aperture positioned such that the third aperture and the hole are co-axial when the at least one pivoting deck segment is in the raised position.

14. The railcar of claim 13, wherein the locking plate further includes a fourth aperture positioned such that the fourth aperture and the hole are co-axial when the at least one pivoting deck segment is in the lowered positioned.

15. The railcar of claim 14, wherein the locking mechanism further includes a locking rod sized to be inserted through the third aperture and the hole when the at least one pivoting deck segment is in the raised position and through the fourth aperture and the hole when the at least one pivoting deck segment is in the lowered position.

16. The railcar of claim 1, wherein the at least one pivoting deck segment includes two pivoting deck segments, and the stationary deck segment is disposed between the two pivoting deck segments.

17. The railcar of claim 1, wherein the at least one pivoting deck segment is substantially horizontal in the lowered position.

18. The railcar of claim 17, wherein the at least one pivoting deck segment is inclined in the raised position relative to the lowered position.

19. The railcar of claim 1, further comprising one or more deck segments vertically spaced from the stationary deck segment and the at least one pivoting deck segment.

* * * * *